US007976296B2

(12) United States Patent
Stover et al.

(10) Patent No.: US 7,976,296 B2
(45) Date of Patent: Jul. 12, 2011

(54) SCROLL COMPRESSOR HAVING CAPACITY MODULATION SYSTEM

(75) Inventors: Robert C. Stover, Versailles, OH (US); Masao Akei, Miamisburg, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 36 days.

(21) Appl. No.: 12/629,432

(22) Filed: Dec. 2, 2009

(65) Prior Publication Data

US 2010/0135836 A1 Jun. 3, 2010

Related U.S. Application Data

(60) Provisional application No. 61/119,530, filed on Dec. 3, 2008.

(51) Int. Cl.
*F04C 18/00* (2006.01)
*F04C 2/00* (2006.01)

(52) U.S. Cl. ..... 418/55.5; 418/15; 418/55.1; 418/57; 418/180; 417/310; 417/308; 417/299

(58) Field of Classification Search ..... 418/15, 418/55.1–55.6, 57, 180, 270; 417/299, 307, 417/308, 310, 440
See application file for complete search history.

(56) References Cited

U.S. PATENT DOCUMENTS

| | | | |
|---|---|---|---|
| 4,382,370 | A | 5/1983 | Suefuji et al. |
| 4,383,805 | A | 5/1983 | Teegarden et al. |
| 4,497,615 | A | 2/1985 | Griffith |
| 4,774,816 | A | 10/1988 | Uchikawa et al. |
| 4,818,195 | A | 4/1989 | Murayama et al. |
| 4,940,395 | A | 7/1990 | Yamamoto et al. |
| 5,074,760 | A | 12/1991 | Hirooka et al. |
| RE34,148 | E | 12/1992 | Terauchi et al. |
| 5,169,294 | A | 12/1992 | Barito |
| 5,192,195 | A | 3/1993 | Iio et al. |
| 5,193,987 | A | 3/1993 | Iio et al. |

(Continued)

FOREIGN PATENT DOCUMENTS

JP 03081588 A 4/1991

(Continued)

OTHER PUBLICATIONS

International Search Report dated May 31, 2010 regarding International Application No. PCT/US2009/066551, 3 pgs.

(Continued)

*Primary Examiner* — Theresa Trieu
(74) *Attorney, Agent, or Firm* — Harness, Dickey & Pierce, P.L.C.

(57) ABSTRACT

A compressor may include a housing, orbiting and non-orbiting scroll members, a first porting, and a second porting. The first and second porting may each extend through the end plate of the non-orbiting scroll member and may each have an angular extent of at least twenty degrees. An ending point of the first porting may be rotationally spaced from a starting point of the first porting by the angular extent in a rotational direction of a drive shaft of the compressor. An ending point of the second porting may be rotationally spaced from a starting point of the second porting by the angular extent in a rotational direction opposite the rotational direction of the drive shaft. The ending point of the second porting may be rotationally spaced from the starting point of the first porting by less than one hundred and eighty degrees in the rotational direction of the drive shaft.

20 Claims, 14 Drawing Sheets

U.S. PATENT DOCUMENTS

| | | | | |
|---|---|---|---|---|
| 5,240,389 | A | 8/1993 | Oikawa et al. | |
| 5,356,271 | A | 10/1994 | Miura et al. | |
| 5,451,146 | A | 9/1995 | Inagaki et al. | |
| 5,551,846 | A | 9/1996 | Taylor et al. | |
| 5,557,897 | A | 9/1996 | Kranz et al. | |
| 5,562,426 | A | 10/1996 | Watanabe et al. | |
| 5,577,897 | A | 11/1996 | Inagaki et al. | |
| 5,639,225 | A | 6/1997 | Matsuda et al. | |
| 5,674,058 | A | 10/1997 | Matsuda et al. | |
| 5,678,985 | A | 10/1997 | Brooke et al. | |
| 5,855,475 | A | 1/1999 | Fujio et al. | |
| 5,885,063 | A | 3/1999 | Makino et al. | |
| 5,993,171 | A | 11/1999 | Higashiyama | |
| 5,993,177 | A | 11/1999 | Terauchi et al. | |
| 6,102,671 | A | 8/2000 | Yamamoto et al. | |
| 6,123,517 | A | 9/2000 | Brooke et al. | |
| 6,132,179 | A | 10/2000 | Higashiyama | |
| 6,164,940 | A | 12/2000 | Terauchi et al. | |
| 6,176,686 | B1 * | 1/2001 | Wallis et al. | 417/310 |
| 6,210,120 | B1 | 4/2001 | Hugenroth et al. | |
| 6,231,316 | B1 | 5/2001 | Wakisaka et al. | |
| 6,273,691 | B1 | 8/2001 | Morimoto et al. | |
| 6,293,767 | B1 * | 9/2001 | Bass | 417/310 |
| 6,350,111 | B1 | 2/2002 | Perevozchikov et al. | |
| 6,412,293 | B1 | 7/2002 | Pham et al. | |
| 6,413,058 | B1 | 7/2002 | Williams et al. | |
| 6,589,035 | B1 | 7/2003 | Tsubono et al. | |
| 6,769,888 | B2 | 8/2004 | Tsubono et al. | |
| 6,884,042 | B2 | 4/2005 | Zili et al. | |
| 6,984,114 | B2 | 1/2006 | Zili et al. | |
| 7,118,358 | B2 | 10/2006 | Tsubono et al. | |
| 7,137,796 | B2 | 11/2006 | Tsubono et al. | |
| 7,229,261 | B2 | 6/2007 | Morimoto et al. | |
| 7,344,365 | B2 | 3/2008 | Takeuchi et al. | |
| 7,354,259 | B2 | 4/2008 | Tsubono et al. | |
| 7,547,202 | B2 * | 6/2009 | Knapke | 418/55.5 |
| 2004/0146419 | A1 | 7/2004 | Kawaguchi et al. | |
| 2004/0197204 | A1 | 10/2004 | Yamanouchi et al. | |
| 2005/0019177 | A1 | 1/2005 | Shin et al. | |
| 2005/0053507 | A1 | 3/2005 | Takeuchi et al. | |
| 2008/0159892 | A1 | 7/2008 | Huang et al. | |
| 2009/0068048 | A1 * | 3/2009 | Stover et al. | 418/55.4 |
| 2009/0071183 | A1 * | 3/2009 | Stover et al. | 418/55.1 |
| 2009/0297377 | A1 * | 12/2009 | Stover et al. | 418/55.1 |
| 2009/0297378 | A1 * | 12/2009 | Stover et al. | 418/55.1 |
| 2009/0297379 | A1 * | 12/2009 | Stover et al. | 418/55.1 |
| 2009/0297380 | A1 * | 12/2009 | Stover et al. | 418/55.2 |
| 2010/0158731 | A1 * | 6/2010 | Akei et al. | 418/55.2 |
| 2010/0254841 | A1 * | 10/2010 | Akei et al. | 418/24 |
| 2010/0300659 | A1 * | 12/2010 | Stover et al. | 418/55.1 |
| 2010/0303659 | A1 * | 12/2010 | Stover et al. | 418/24 |

FOREIGN PATENT DOCUMENTS

| | | | |
|---|---|---|---|
| JP | 2000161263 | A | 6/2000 |
| JP | 2007154761 | A | 6/2007 |

OTHER PUBLICATIONS

Written Opinion of the International Searching Authority dated May 31, 2010 regarding International Application No. PCT/US2009/066551, 3 pgs.

U.S. Appl. No. 12/789,105, filed May 27, 2010, Stover et al.

U.S. Appl. No. 12/788,786, filed May 27, 2010, Stover et al.

U.S. Appl. No. 12/474,633, filed May 29, 2009, Stover et al.

U.S. Appl. No. 12/474,736, filed May 29, 2009, Akei et al.

U.S. Appl. No. 12/474,806, filed May 29, 2009, Stover et al.

U.S. Appl. No. 12/474,868, filed May 29, 2009, Stover et al.

U.S. Appl. No. 12/474,954, filed May 29, 2009, Stover et al.

PCT/US2009/045630, May 29, 2009, Stover et al.

* cited by examiner

SCROLL COMPRESSOR HAVING CAPACITY MODULATION SYSTEM

CROSS-REFERENCE TO RELATED APPLICATIONS

This application claims the benefit of U.S. Provisional Application No. 61/119,530, filed on Dec. 3, 2008. The entire disclosure of the above application is incorporated herein by reference.

FIELD

The present disclosure relates to compressors, and more specifically to scroll compressors having capacity modulation systems.

BACKGROUND

This section provides background information related to the present disclosure which is not necessarily prior art.

Scroll compressors include a variety of capacity modulation mechanisms to vary operating capacity of a compressor. The capacity modulation mechanisms may include fluid passages extending through a scroll member to selectively provide fluid communication between compression pockets and another pressure region of the compressor.

SUMMARY

This section provides a general summary of the disclosure, and is not a comprehensive disclosure of its full scope or all of its features.

A compressor may include a housing, a non-orbiting scroll member, a first porting, an orbiting scroll member and a second porting. The non-orbiting scroll member may be supported within the housing and may include a first end plate and a first spiral wrap extending from the first end plate. The first porting may extend through the first end plate and may have a first angular extent of at least twenty degrees. The orbiting scroll member may be driven by a drive shaft and supported within the housing. The orbiting scroll member may include a second end plate having a second spiral wrap extending therefrom and meshingly engaged with the first spiral wrap to form a series of compression pockets. The first porting may be in communication with a first of the compression pockets during a portion of a compression cycle of the orbiting and non-orbiting scroll members. The first and second spiral wraps may abut one another at a first location to define first modulated capacity pockets when the orbiting scroll member is in a first position. The first modulated capacity pockets may include a set of radially outermost compression pockets located radially inward relative to the first porting and isolated from communication with the first porting during an entirety of the compression cycle.

The first porting may be aligned with the second spiral wrap at a location radially outward from and directly adjacent the first modulated capacity pockets when the orbiting scroll member is in the first position. A starting point of the first porting may be rotationally aligned with the first location and an ending point of the first porting may be rotationally spaced from the starting point by the first angular extent in a rotational direction of the drive shaft. The second porting may extend through the first end plate and may have a second angular extent of at least twenty degrees. The second porting may be in communication with the second of the compression pockets during a portion of the compression cycle. The first and second spiral wraps may abut one another at a second location to define second modulated capacity pockets when the orbiting scroll member is in a second position subsequent to the first position. The second modulated capacity pockets may include a set of radially outermost compression pockets located radially inward relative to the first and second porting and isolated from communication with the first and second porting during an entirety of the compression cycle. A starting point of the second porting may be rotationally aligned with the second location and an ending point of the second porting may be rotationally spaced from the starting point of the second porting in a rotational direction opposite the rotational direction of the drive shaft. The ending point of the second porting may be rotationally spaced from the starting point of the first porting by less than one hundred and eighty degrees in the rotational direction of the drive shaft.

The second porting may be aligned with the second spiral wrap at a location radially outward from and directly adjacent the second set of radially outermost pockets when the orbiting scroll member is in the second position. The second porting may be in communication with the first modulated capacity pockets when the orbiting scroll member is in the first position. The second modulated capacity pockets may correspond to the first modulated capacity pockets after displacement of the orbiting scroll member from the first position to the second position.

The compressor may include a third porting extending through the first end plate and being in communication with one of the compression pockets located radially outward from the first modulated capacity pockets when the orbiting scroll member is in the first position. The third porting may be located radially outward from a radially outer surface of the first spiral wrap less than three hundred and sixty degrees inward along the first spiral wrap from an outer end thereof. The first porting may be located radially inward relative to the third porting.

A pressure in the first porting may continuously increase during the compression cycle. The second spiral wrap may overly an entirety of the first porting when the orbiting scroll member is in the first position. The second spiral wrap may overly an entirety of the second porting when the orbiting scroll member is in the second position.

The first porting may be isolated from communication with the compression pockets by the second spiral wrap when the orbiting scroll member is in the first position. The first porting may include a continuous aperture along the angular extent thereof. Alternatively, the first porting may include a series of discrete apertures along the angular extent thereof. A valve member may be in communication with the first porting to selectively provide communication between one of the compression pockets and a bypass location external to the compression pocket. The bypass location may include a suction pressure region of the compressor.

The first porting may be in communication with a suction pressure region of the compressor. The width of the first porting may be less than the width of the second spiral wrap. The spiral extent of the first spiral wrap may be greater than the spiral extent of the second spiral wrap, forming an asymmetric scroll arrangement.

In another arrangement, a compressor may include a housing, a non-orbiting scroll member, a first porting, an orbiting scroll member and a second porting. The non-orbiting scroll member may be supported within the housing and may include a first end plate and a first spiral wrap extending from the first end plate. The first porting may extend through the first end plate and may have a first angular extent of at least twenty degrees. The orbiting scroll member may be driven by a draft shaft and supported within the housing. The orbiting scroll member may include a second end plate having a second spiral wrap extending therefrom and meshingly engaged with the first spiral wrap to form a series of compression pockets. The first spiral wrap may have a greater spiral extent than the second spiral wrap, forming an asymmetric scroll arrangement. The first porting may be in communication with a first of the compression pockets during a portion of a compression cycle of the orbiting and non-orbiting scroll members. The first and second spiral wraps may abut one another at a first location to define first modulated capacity pockets when the orbiting scroll member is in a first position. The first modulated capacity pockets may include a set of radially outermost compression pockets located radially inward relative to the first porting and isolated from communication with the first porting during an entirety of a compression cycle.

The first porting may be aligned with the second spiral wrap at a location radially outward from and directly adjacent the first modulated capacity pockets when the orbiting scroll member is in the first position. The second porting may extend through the first end plate and may have a second angular extent of at least twenty degrees. The second porting may be in communication with one of the first modulated capacity pockets when the orbiting scroll member is in the first position and may be in communication with a second of the compression pockets during a portion of the compression cycle. The first and second spiral wraps may abut one another at a second location to define modulated capacity pockets when the orbiting scroll member is in a second position subsequent to the first position. The second modulated capacity pockets may include a set of radially outermost compression pockets located radially inward relative to the first and second porting and isolated from communication with the first and second porting during an entirety of the compression cycle.

A starting point of the first porting may be rotationally aligned with the first location and an ending point of the first porting may be rotationally spaced from the starting point by the first angular extent in a rotational direction of the drive shaft. A starting point at the second porting may be rotationally aligned with the second location and an ending point of the second porting may be rotationally spaced from the starting point of the second porting in a rotational direction opposite the rotational direction of the drive shaft. The ending point of the second porting may be rotationally spaced from the starting point of the first porting by less than one hundred and eighty degrees in the rotational direction of the driveshaft.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
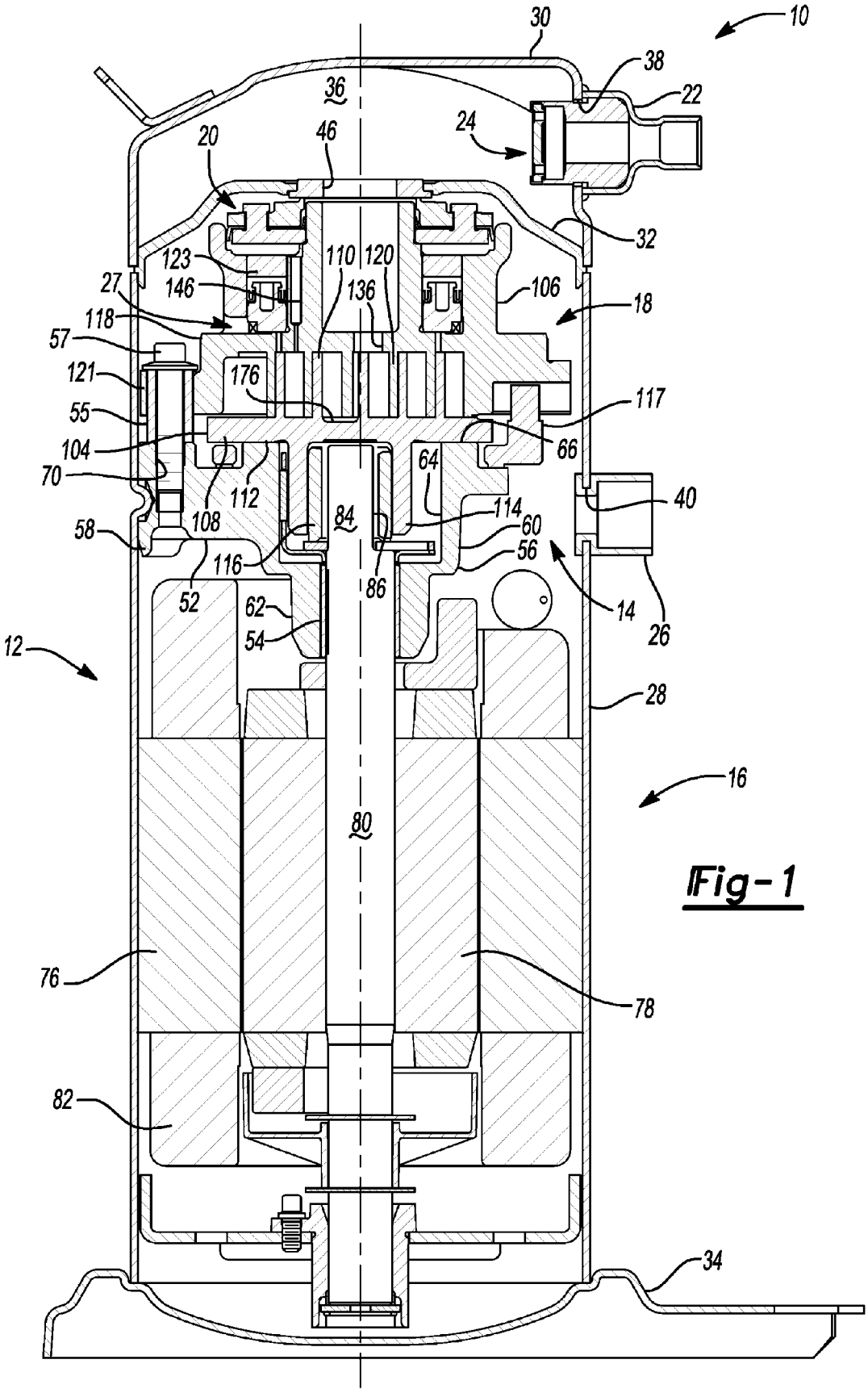
FIG. 1 is a section view of a compressor according to the present disclosure.
Figure 2:
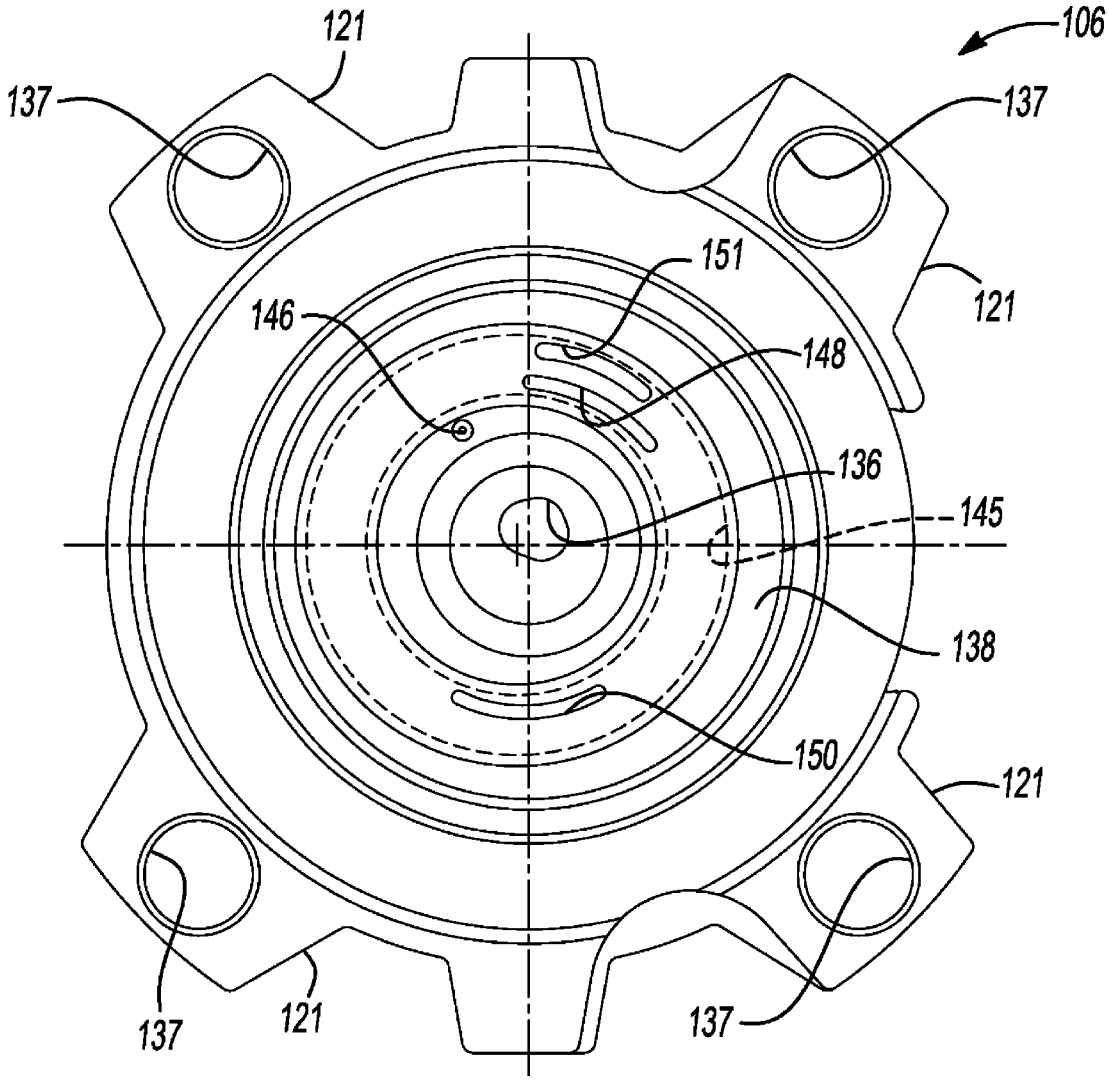
FIG. 2 is a plan view of a non-orbiting scroll member of the compressor of FIG. 1.
Figure 3:
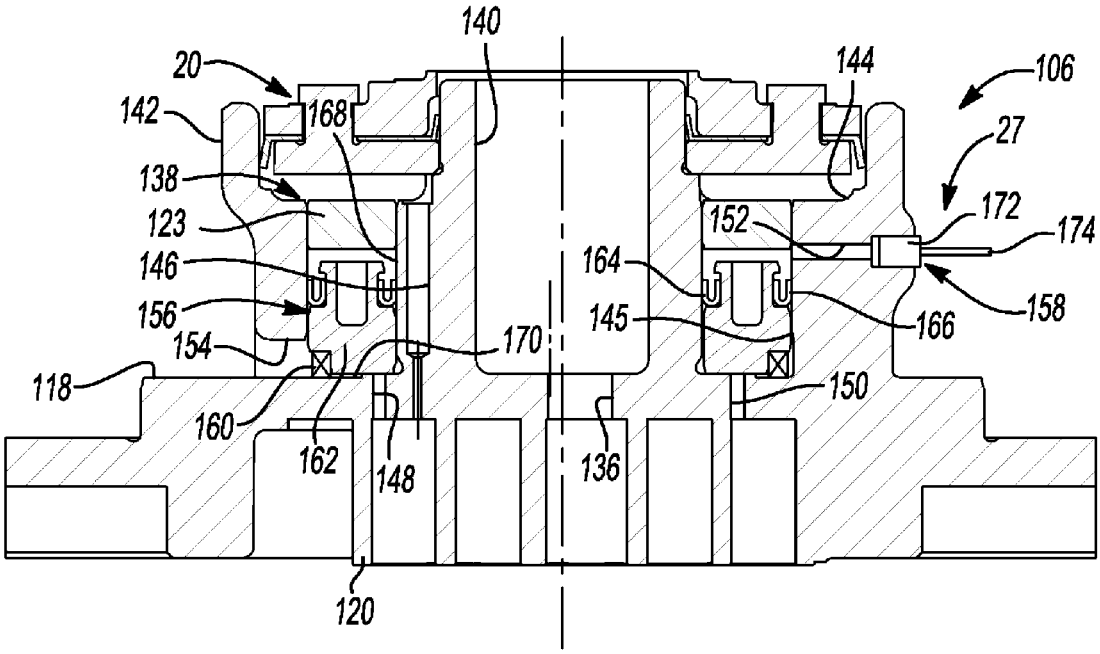
FIG. 3 is a section view of a non-orbiting scroll, seal assembly, and modulation system of the compressor of FIG. 1.
Figure 4:
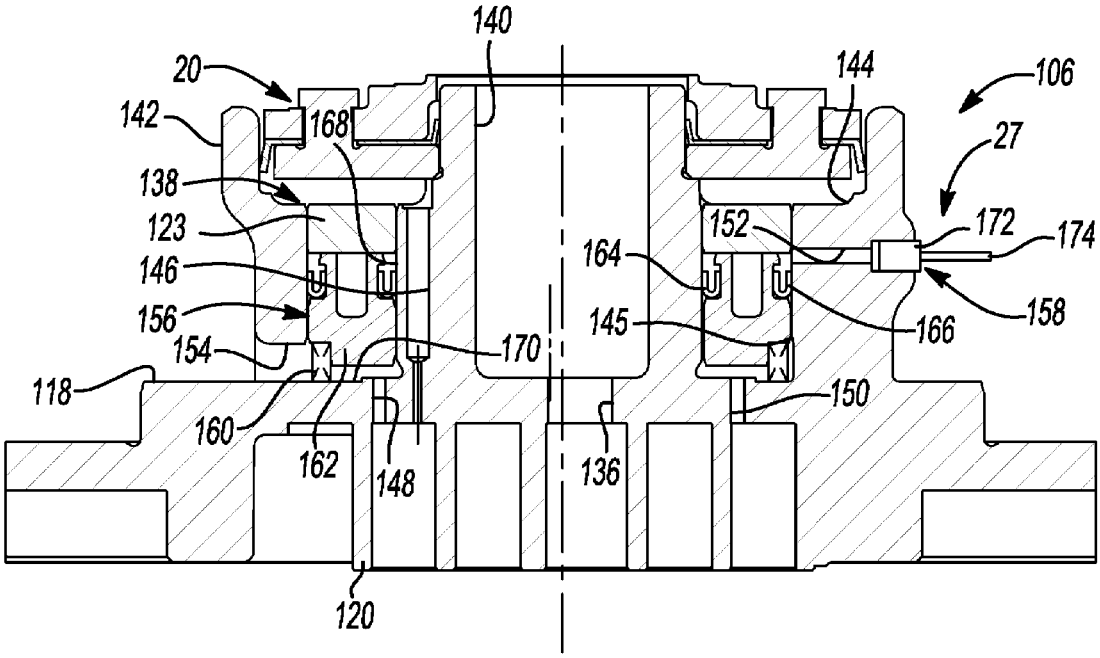
FIG. 4 is an additional section view of the non-orbiting scroll, seal assembly, and modulation system of FIG. 3.

The following description is merely exemplary in nature and is not intended to limit the present disclosure, application, or uses. It should be understood that throughout the drawings, corresponding reference numerals indicate like or corresponding parts and features.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 may include a hermetic shell assembly 12, a main bearing housing assembly 14, a motor assembly 16, a compression mechanism 18, a seal assembly 20, a refrigerant discharge fitting 22, a discharge valve assembly 24, a suction gas inlet fitting 26, and a modulation assembly 27. Shell assembly 12 may house main bearing housing assembly 14, motor assembly 16, and compression mechanism 18.

Shell assembly 12 may generally form a compressor housing and may include a cylindrical shell 28, an end cap 30 at the upper end thereof, a transversely extending partition 32, and a base 34 at a lower end thereof. End cap 30 and partition 32 may generally define a discharge chamber 36. Discharge chamber 36 may generally form a discharge muffler for compressor 10. Refrigerant discharge fitting 22 may be attached to shell assembly 12 at opening 38 in end cap 30. Discharge valve assembly 24 may be located within discharge fitting 22 and may generally prevent a reverse flow condition. Suction gas inlet fitting 26 may be attached to shell assembly 12 at opening 40. Partition 32 may include a discharge passage 46 therethrough providing communication between compression mechanism 18 and discharge chamber 36.

Main bearing housing assembly 14 may be affixed to shell 28 at a plurality of points in any desirable manner, such as staking. Main bearing housing assembly 14 may include a main bearing housing 52, a first bearing 54 disposed therein, bushings 55, and fasteners 57. Main bearing housing 52 may include a central body portion 56 having a series of arms 58 extending radially outwardly therefrom. Central body portion 56 may include first and second portions 60, 62 having an opening 64 extending therethrough. Second portion 62 may house first bearing 54 therein. First portion 60 may define an annular flat thrust bearing surface 66 on an axial end surface thereof. Arm 58 may include apertures 70 extending therethrough and receiving fasteners 57.

Motor assembly 16 may generally include a motor stator 76, a rotor 78, and a drive shaft 80. Windings 82 may pass through stator 76. Motor stator 76 may be press fit into shell 28. Drive shaft 80 may be rotatably driven by rotor 78. Rotor 78 may be press fit on drive shaft 80. Drive shaft 80 may include an eccentric crank pin 84 having a flat 86 thereon.

Compression mechanism 18 may generally include an orbiting scroll 104 and a non-orbiting scroll 106. Orbiting scroll 104 may include an end plate 108 having a spiral vane or wrap 110 on the upper surface thereof and an annular flat thrust surface 112 on the lower surface. Thrust surface 112 may interface with annular flat thrust bearing surface 66 on main bearing housing 52. A cylindrical hub 114 may project downwardly from thrust surface 112 and may have a drive bushing 116 rotatively disposed therein. Drive bushing 116 may include an inner bore in which crank pin 84 is drivingly disposed. Crank pin flat 86 may drivingly engage a flat surface in a portion of the inner bore of drive bushing 116 to provide a radially compliant driving arrangement. An Oldham coupling 117 may be engaged with the orbiting and non-orbiting scrolls 104, 106 to prevent relative rotation therebetween.

With additional reference to FIGS. 2-5, non-orbiting scroll 106 may include an end plate 118 having a spiral wrap 120 on a lower surface thereof, a series of radially outwardly extending flanged portions 121, and an annular ring 123. Compression mechanism 18 may form an asymmetric scroll arrangement where spiral wrap 120 has a greater rotational extent than spiral wrap 110. The spiral wrap 120 may be up to 180 degrees greater than spiral wrap 110. In the example shown in FIG. 5, spiral wrap 120 may extend approximately 180 degrees greater than spiral wrap 110. Spiral wrap 120 may form a meshing engagement with wrap 110 of orbiting scroll 104, thereby creating a series of pockets. The pockets created by spiral wraps 110, 120 may change throughout a compression cycle of compression mechanism 18, as discussed below. End plate 118 may include a first porting 148 therein, as discussed below. End plate 118 may include first porting 148 alone or may additionally include a second porting 150. Further, end plate 118 may optionally include a third porting 151.

Figure 5:
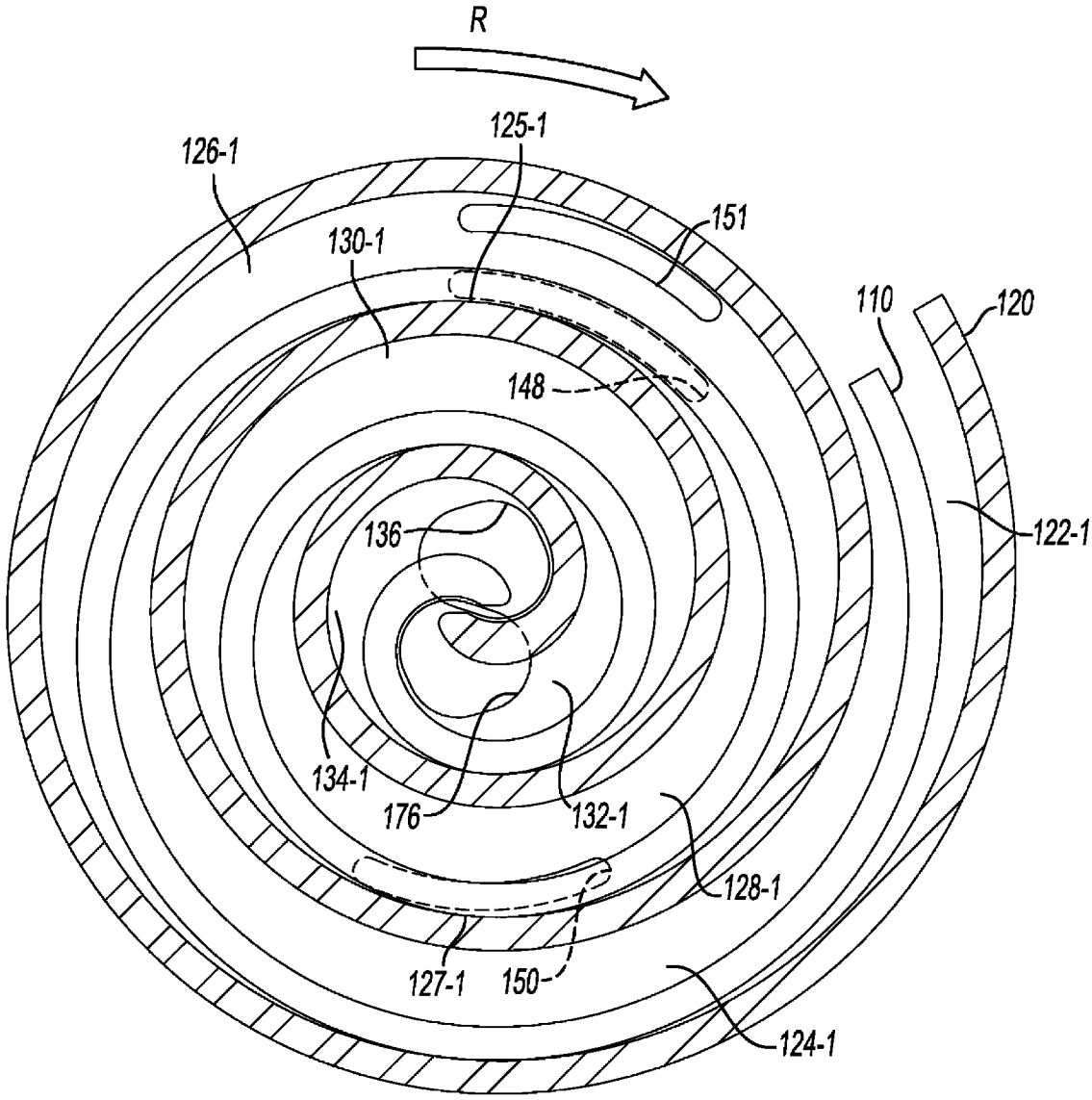
FIG. 5 is a schematic illustration of the orbiting scroll member of FIG. 1 in a first orientation.

FIG. 5 illustrates the orbiting scroll 104 in a first position. First, second, third, fourth, fifth, sixth, and seventh pockets 122-1, 124-1, 126-1, 128-1, 130-1, 132-1, 134-1 may be formed by the spiral wraps 110, 120 when the orbiting scroll 104 is in the first position. In the first position, first and second pockets 122-1, 124-1 may be in communication with a suction pressure region of compressor 10, third, fourth and fifth pockets 126-1, 128-1, 130-1 may form compression pockets, and sixth and seventh pockets 132-1, 134-1 may form a discharge pocket in communication with a discharge passage 136 in non-orbiting scroll 106. A recess 176 in orbiting scroll 104 may assist in providing fluid communication between sixth pocket 132-1 and discharge passage 136. Fourth and fifth pockets 128-1, 130-1 may form first modulated capacity pockets for compression mechanism 18 relative to first porting 148.

The first modulated capacity pockets may generally be defined as the radially outermost compression pockets that are disposed radially inwardly relative to first porting 148 and isolated from first porting 148 from the time the first modulated capacity pockets are formed until the volume in the first modulated capacity pockets is discharged through discharge passage 136. Thus, the volume in the first modulated capacity pockets may be isolated from first porting 148 during a remainder of a compression cycle associated therewith, as discussed below. The volume of the first modulated capacity pockets may be at a maximum volume when orbiting scroll 104 is in the first position and may be continuously compressed until being discharged through discharge passage 136.

Spiral wrap 110 of orbiting scroll 104 may abut an outer radial surface of spiral wrap 120 at a first location 125-1 and may abut the inner radial surface of spiral wrap 120 at a second location 127-1 generally opposite the first location 125-1 when orbiting scroll 104 is in the first position. A starting point of first porting 148 may be rotationally aligned with and adjacent the first location 125-1. An ending point of first porting 148 may be rotationally offset from the starting point in a rotational direction (R) of drive shaft 80. First porting 148 may extend at least twenty degrees along spiral wrap 110 in the rotational direction (R) from the starting point to the ending point thereof. First porting 148 may be sealed by spiral wrap 110 when orbiting scroll 104 is in the first position. A portion of second porting 150 may be in communication with fourth and fifth pockets 128-1, 130-1 when orbiting scroll 104 is in the first position.

Figure 6:
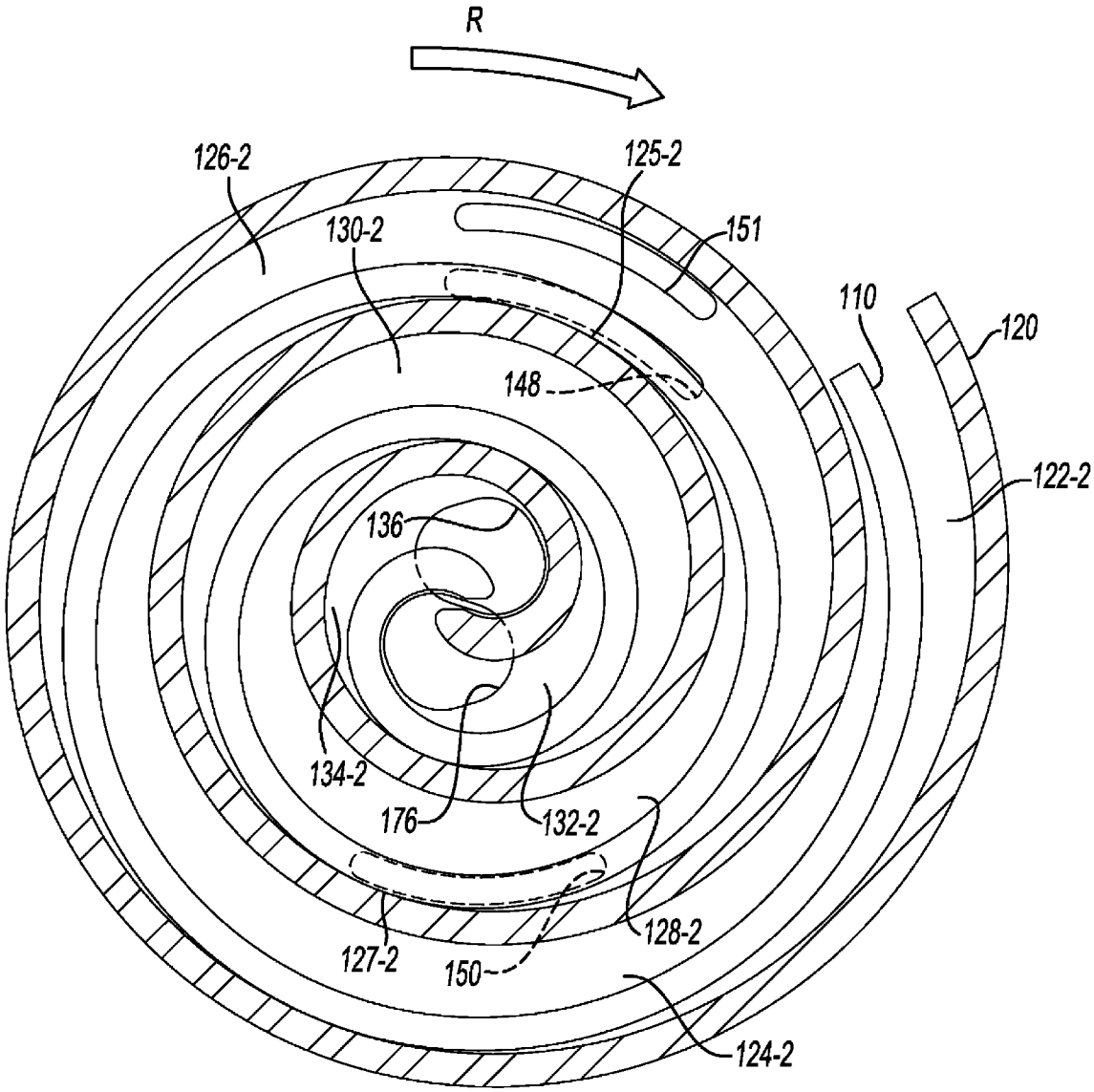
FIG. 6 is a schematic illustration of the orbiting scroll member of FIG. 1 in a second orientation.

FIG. 6 illustrates the orbiting scroll 104 in a second position. First, second, third, fourth, fifth, sixth and seventh pockets 122-2, 124-2, 126-2, 128-2, 130-2, 132-2, 134-2 may be formed by the spiral wraps 110, 120 when the orbiting scroll 104 is in the second position. In the second position, first and second pockets 122-2, 124-2 may form suction pockets, third, fourth and fifth pockets 126-2, 128-2, 130-2 may form compression pockets and sixth and seventh pockets 132-2, 134-2 may form discharge pockets in communication with discharge passage 136 in non-orbiting scroll 106. Fourth and fifth pockets 128-2, 130-2 may form second modulated capacity pockets for compression mechanism 18 relative to first and second porting 148, 150.

In the second position, the second modulated capacity pockets may generally be defined as the radially outermost compression pockets that are disposed radially inwardly relative to first and second porting 148, 150 and isolated from first and second porting 148, 150 from the time the orbiting scroll 104 is in the second position until the volume in the second modulated capacity pockets is discharged through discharge passage 136. The second modulated capacity pockets may correspond to the first modulated capacity pockets after compression resulting from orbiting scroll 104 travelling from the first position to the second position. For example, the compression from the first position to the second position may correspond to approximately twenty degrees of rotation of drive shaft 80.

Spiral wrap 110 of orbiting scroll 104 may abut an outer radial surface of spiral wrap 120 at a third location 125-2 and may abut an inner radial surface of spiral wrap 120 at a fourth location 127-2 generally opposite the third location 125-2 when orbiting scroll 104 is in the second position. A starting point of second porting 150 may be rotationally aligned with and adjacent the fourth location 127-2. An ending point of second porting 150 may be rotationally offset from the starting point in a rotational direction opposite the rotational direction (R) of drive shaft 80. Second porting 150 may extend at least twenty degrees along spiral wrap 110 opposite the rotational direction (R) from the starting point to the ending point thereof. Second porting 150 may be sealed by spiral wrap 110 when orbiting scroll 104 is in the second position. The ending point of the second porting 150 may be rotationally spaced from the starting point of the first porting 148 by less than 180 degrees in the rotational direction (R) of the drive shaft 80.

While the first and second porting 148, 150 are discussed in combination with an asymmetric scroll arrangement, it is understood that the geometry of the first and second porting 148, 150 and arrangement relative to one another applies equally to symmetric scroll arrangements.

FIGS. 5-11 illustrate a portion of a compression cycle for compression mechanism 18. FIGS. 5 and 6 illustrate fourth pockets 128-1, 128-2 and fifth pockets 130-1, 130-2 partially through their compression cycle. The compression of the first modulated capacity pockets (shown as fourth and fifth pockets 128-1, 130-1 in FIG. 5) to a discharge location may generally constitute the remainder of a compression cycle discussed above. The second modulated capacity pockets (shown as fourth and fifth pockets 128-2, 130-2 in FIG. 6) may generally correspond to the first modulated capacity pockets after compression from the first position of orbiting scroll member 104 to the second position.

Figure 7:
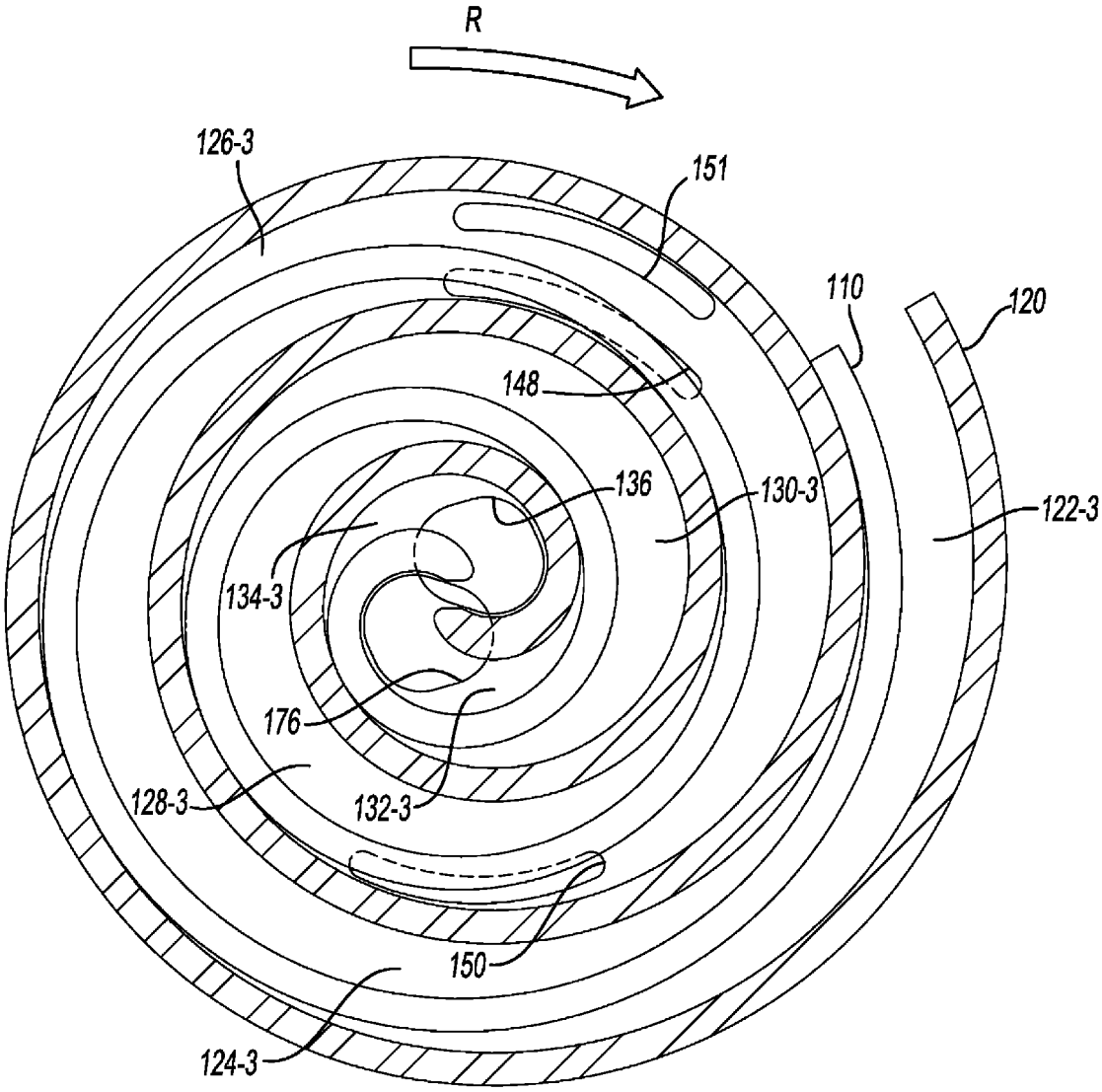
FIG. 7 is a schematic illustration of the orbiting scroll member of FIG. 1 in a third orientation.

FIG. 7 generally illustrates the start of the compression cycle for second pocket 124-3. FIGS. 7-13 depict three hundred and twenty degrees of rotation of drive shaft 80 and the corresponding compression of first, second, third, fourth, fifth, sixth and seventh pockets 122-3, 124-3, 126-3, 128-3, 130-3, 132-3, 134-3. FIG. 7 generally illustrates the compression of second, third, fourth, fifth, sixth and seventh pockets 124-2, 126-2, 128-2, 130-2, 132-2, 134-2 to second, third, fourth, fifth, sixth and seventh pockets 124-3, 126-3, 128-3, 130-3, 132-3, 134-3 resulting from sixty degrees of rotation of drive shaft 80 relative to FIG. 5. First pocket 122-3 remains a suction pocket in FIG. 7.

Figure 8:
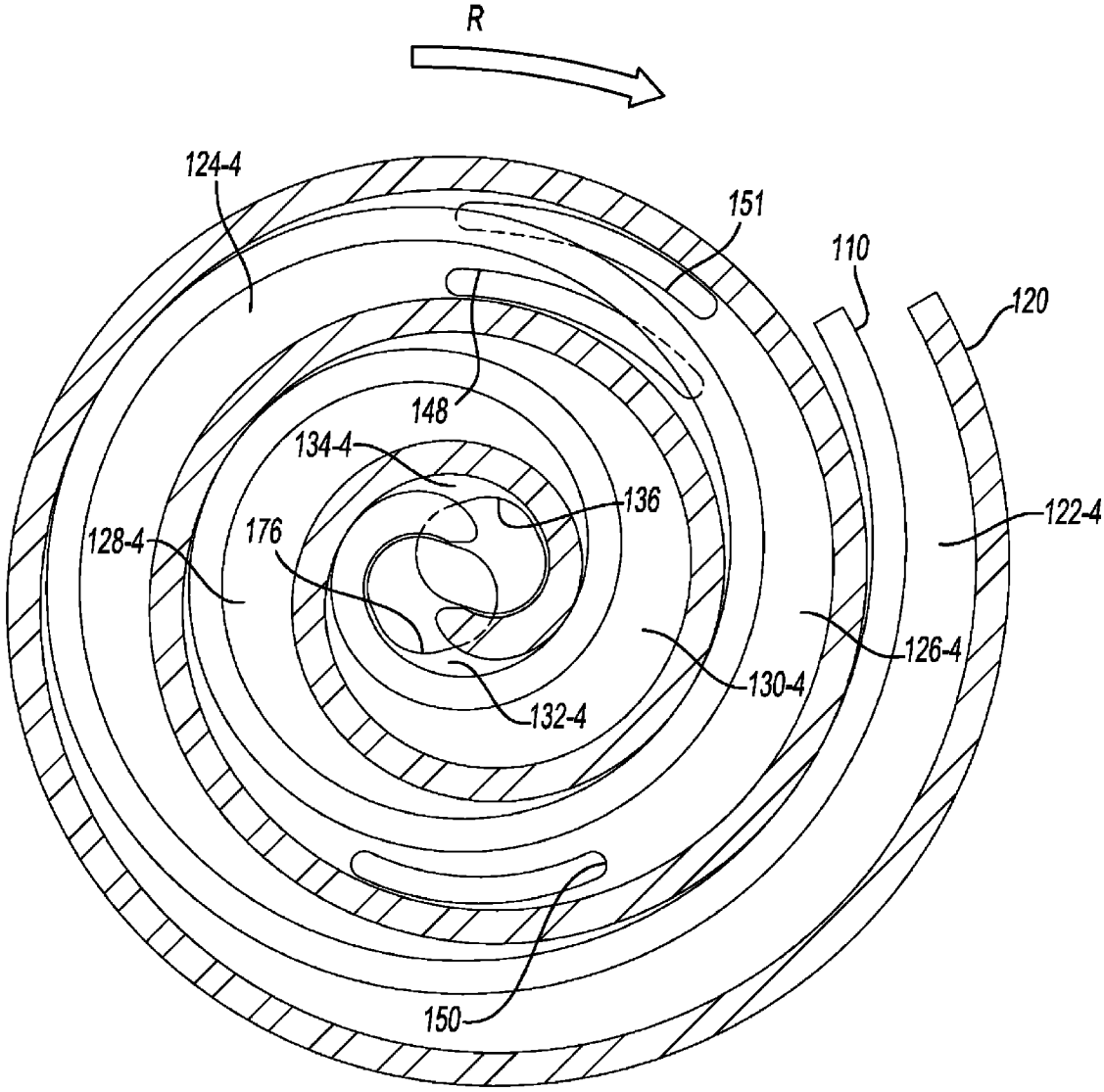
FIG. 8 is a schematic illustration of the orbiting scroll member of FIG. 1 in a fourth orientation.
Figure 9:
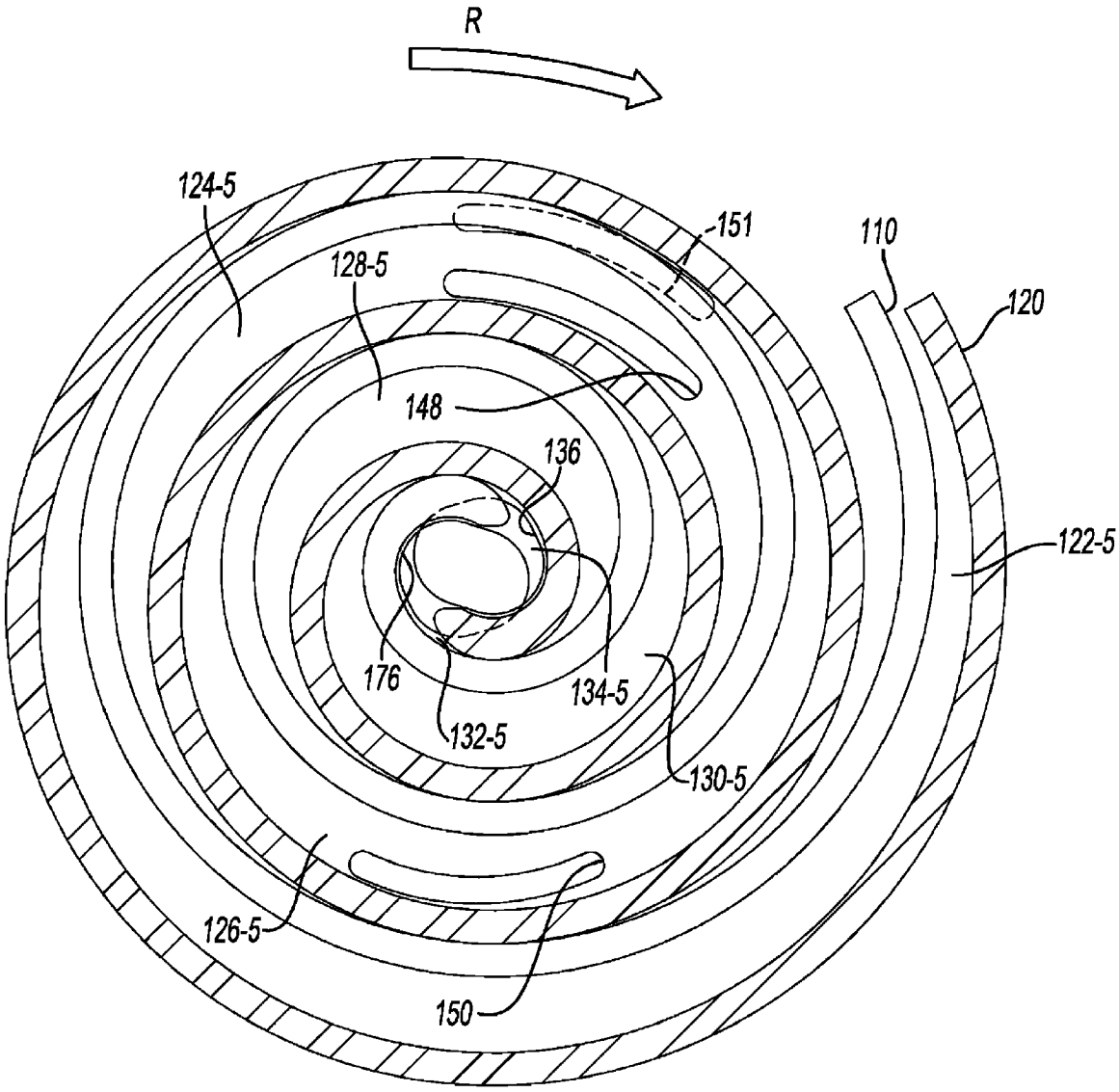
FIG. 9 is a schematic illustration of the orbiting scroll member of FIG. 1 in a fifth orientation.

FIG. 8 generally illustrates the compression of second, third, fourth, fifth, sixth and seventh pockets 124-3, 126-3, 128-3, 130-3, 132-3, 134-3 to second, third, fourth, fifth, sixth and seventh pockets 124-4, 126-4, 128-4, 130-4, 132-4, 134-4 resulting from one hundred and twenty degrees of rotation of drive shaft 80 relative to FIG. 5. First pocket 122-4 remains a suction pocket in FIG. 8. FIG. 9 generally illustrates the compression of second, third, fourth, fifth, sixth and seventh pockets 124-4, 126-4, 128-4, 130-4, 132-4, 134-4 to second, third, fourth, fifth, sixth, and seventh pockets 124-5, 126-5, 128-5, 130-5, 132-5, 134-5 resulting from one hundred and eighty degrees of rotation of drive shaft 80 relative to FIG. 5. First pocket 122-5 remains a suction pocket in FIG. 9.

Figure 10:
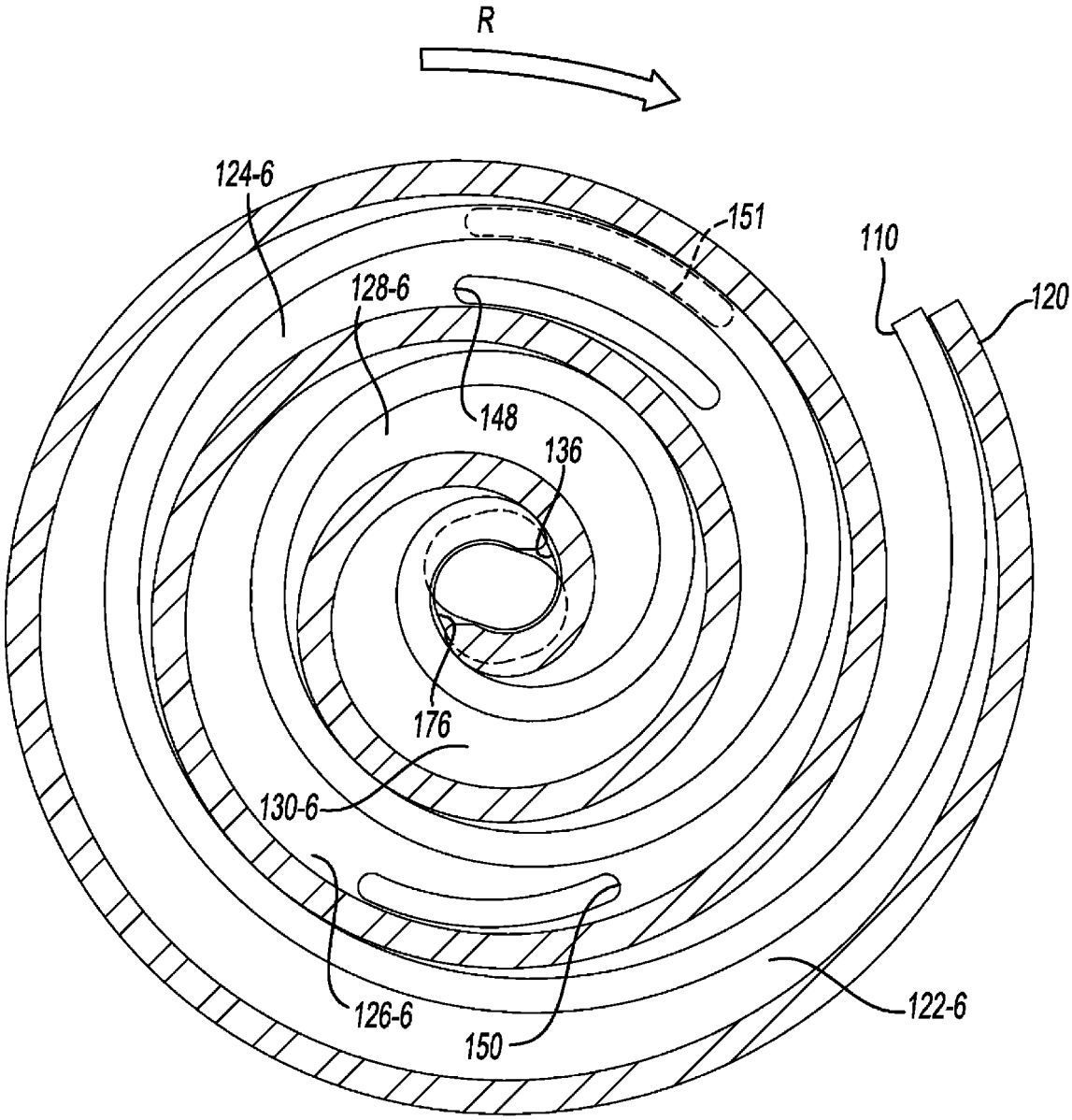
FIG. 10 is a schematic illustration of the orbiting scroll member of FIG. 1 in a sixth orientation.
Figure 11:
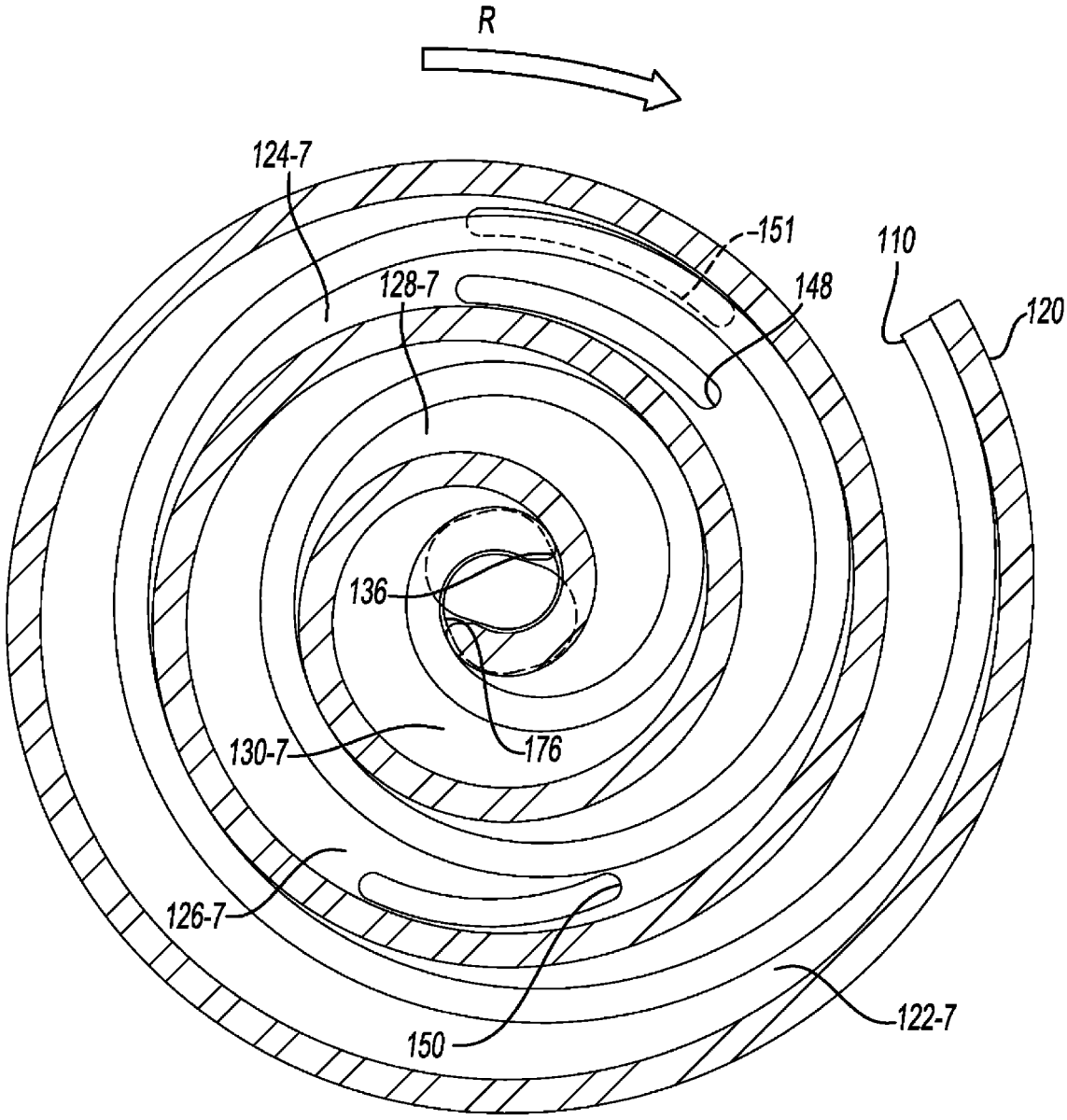
FIG. 11 is a schematic illustration of the orbiting scroll member of FIG. 1 in a seventh orientation.

FIG. 10 generally illustrates the compression of second, third, fourth, fifth, sixth and seventh pockets 124-5, 126-5, 128-5, 130-5, 132-5, 134-5 to second, third, fourth and fifth pockets 124-6, 126-6, 128-6, 130-6 resulting from two hundred and twenty degrees of rotation of drive shaft 80 relative to FIG. 5. FIG. 10 represents the completion of the compression cycle associated with sixth and seventh pockets 132-5, 134-5. First pocket 122-6 remains a suction pocket in FIG. 10. FIG. 11 generally illustrates the start of the compression cycle for first pocket 122-7, where first pocket 122-7 is isolated from a suction pressure region of the compressor 10. FIG. 11 generally illustrates the compression of first, second, third, fourth and fifth pockets 122-6, 124-6, 126-6, 128-6, 130-6 to first, second, third, fourth and fifth pockets 122-7, 124-7, 126-7, 128-7, 130-7 resulting from two hundred and forty degrees of rotation of drive shaft 80 relative to FIG. 5.

Figure 12:
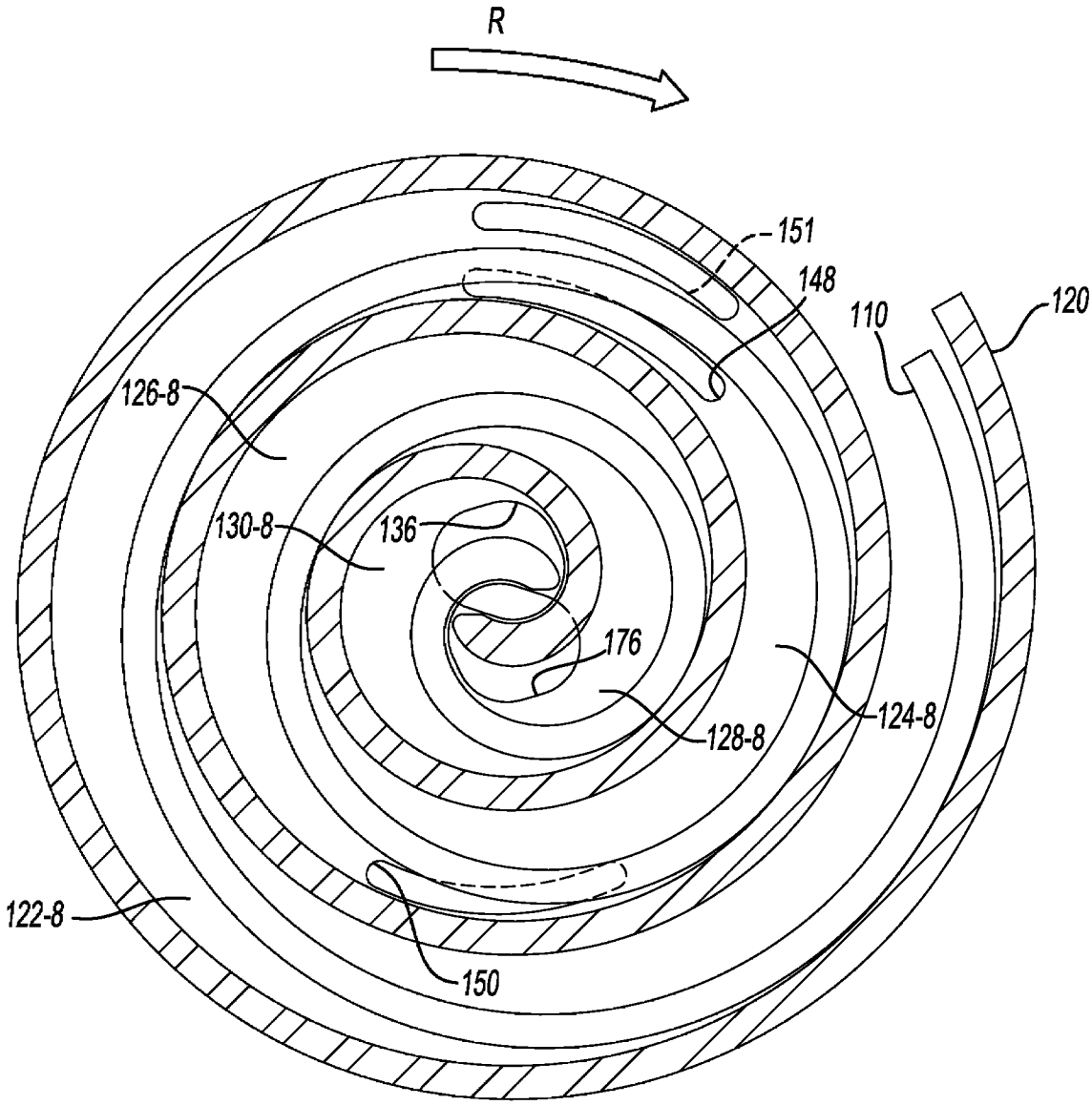
FIG. 12 is a schematic illustration of the orbiting scroll member of FIG. 1 in an eighth orientation.
Figure 13:
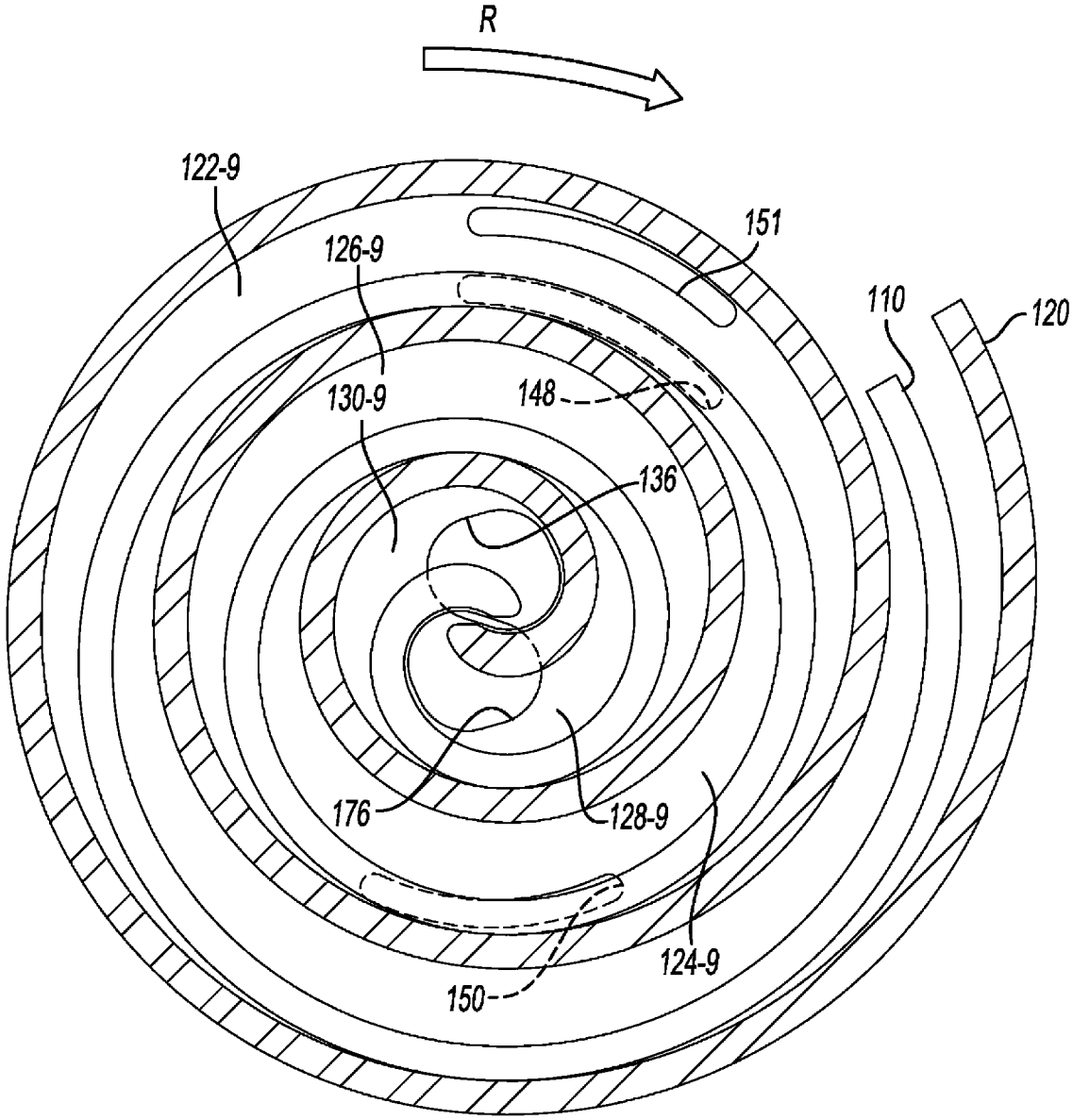
FIG. 13 is a schematic illustration of the orbiting scroll member of FIG. 1 in a ninth orientation.

FIG. 12 generally illustrates the compression of first, second, third, fourth and fifth pockets 122-7, 124-7, 126-7, 128-7, 130-7 to first, second, third, fourth and fifth pockets 122-8, 124-8, 126-8, 128-8, 130-8 resulting from three hundred degrees of rotation of drive shaft 80 relative to FIG. 5. FIG. 13 generally illustrates the compression of first, second, third, fourth and fifth pockets 122-8, 124-8, 126-8, 128-8, 130-8 to first, second, third, fourth and fifth pockets 122-9, 124-9, 126-9, 128-9, 130-9 resulting from three hundred and sixty degrees of rotation of drive shaft 80 relative to FIG. 5. Second and third pockets 124-9, 126-9 become the first modulated capacity pockets in FIG. 13.

Figure 14:
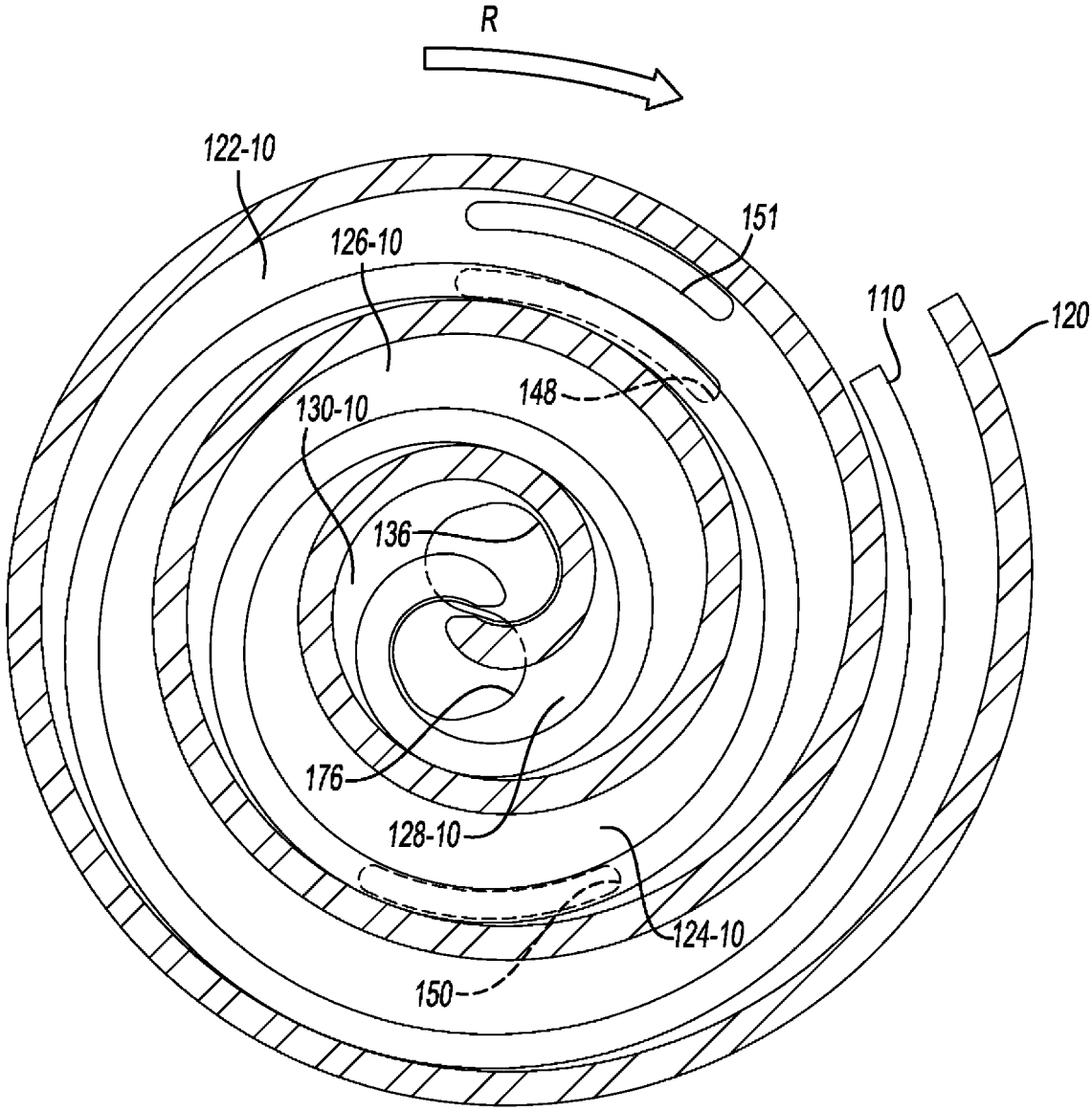
FIG. 14 is a schematic illustration of the orbiting scroll member of FIG. 1 in a tenth orientation.

FIG. 14 generally illustrates the compression of first, second, third, fourth and fifth pockets 122-9, 124-9, 126-9, 128-9, 130-9 to first, second, third, fourth and fifth pockets 122-10, 124-10, 126-10, 128-10, 130-10 resulting from three hundred and eighty degrees of rotation of drive shaft 80 relative to FIG. 5. Second and third pockets 122-10, 124-10 become the second modulated capacity pockets in FIG. 14.

As illustrated in FIGS. 5-14 and discussed further below, third porting 151 may form an auxiliary porting. For example, as seen in FIG. 11, when first pocket 122-7 begins its compression cycle, it may be isolated from both first and second porting 148, 150. However, third porting 151 may be in communication with first pocket 122-7.

Referring back to FIG. 4, non-orbiting scroll 106 may include an annular recess 138 in the upper surface thereof defined by parallel coaxial inner and outer side walls 140, 142. Annular ring 123 may be disposed within annular recess 138 and may separate annular recess 138 into first and second annular recesses 144, 145. First and second annular recesses 144, 145 may be isolated from one another. First annular recess 144 may provide for axial biasing of non-orbiting scroll 106 relative to orbiting scroll 104, as discussed below. More specifically, a passage 146 may extend through end plate 118 of non-orbiting scroll 106, placing first annular recess 144 in fluid communication with one of the pockets formed by the meshing engagement between the spiral wraps 110, 120.

Figure 15:
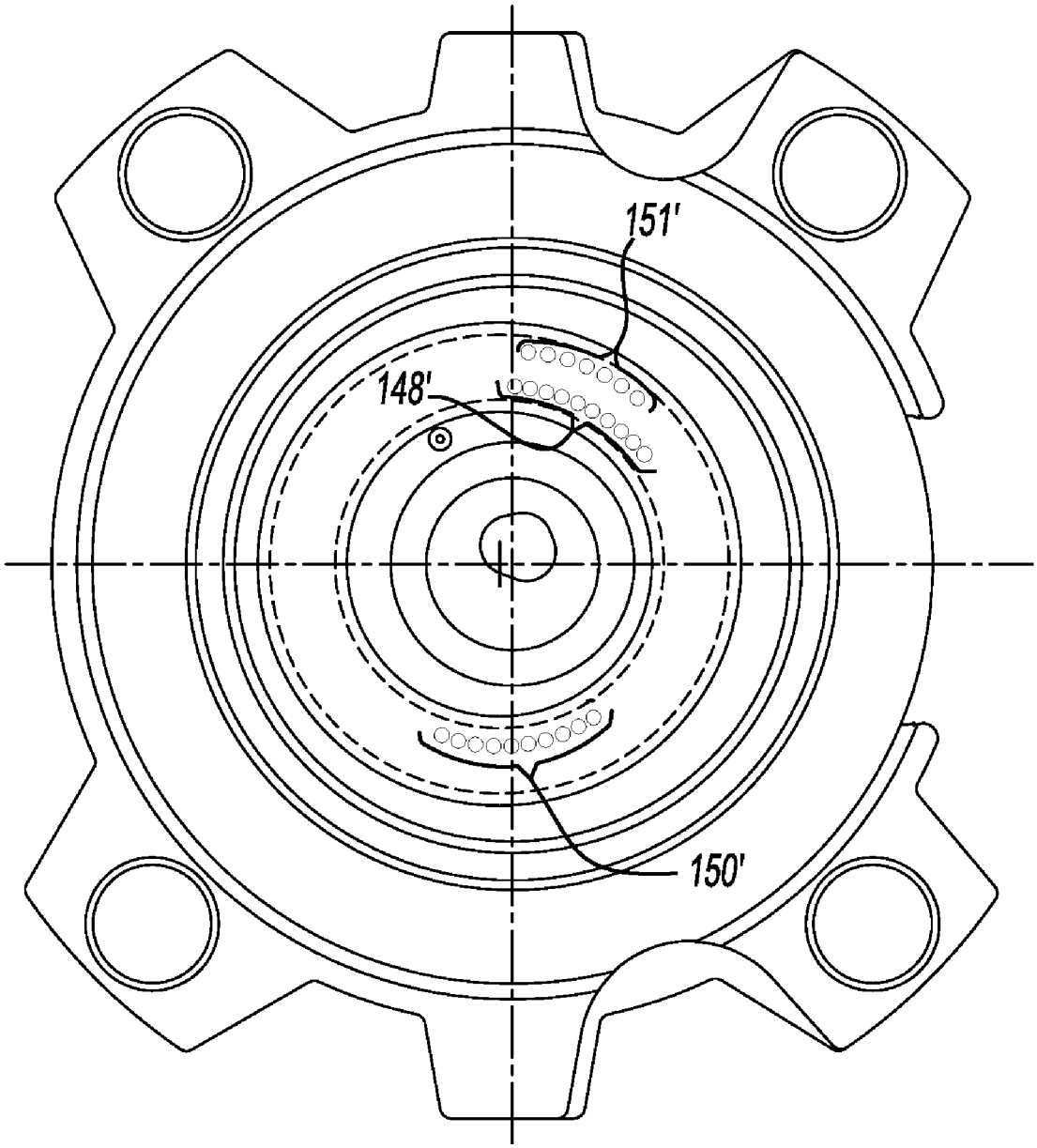
FIG. 15 is a schematic illustration of an alternate compression mechanism according to the present disclosure.

First, second, and third porting 148, 150, 151 are each shown as a continuous opening in FIGS. 5-14. However, first, second, and third porting 148', 150', 151' may each alternatively be in the form of a series of discrete openings as seen in FIG. 15.

First and second porting 148, 150 may place second annular recess 145 in communication with two of the pockets formed by the meshing engagement between the spiral wraps 110, 120 during a portion of the compression cycle of compression mechanism 18. Second annular recess 145 may be in communication with different ones of the pockets than first annular recess 144. More specifically, second annular recess 145 may be in communication with pockets located radially outwardly relative to the pocket in communication with the first annular recess 144. Therefore, first annular recess 144 may operate at a pressure greater than an operating pressure of second annular recess 145. First and second radial passages 152, 154 may extend into second annular recess 145 and may cooperate with modulation assembly 27 as discussed below.

Seal assembly 20 may include a floating seal located within first annular recess 144. Seal assembly 20 may be axially displaceable relative to shell assembly 12 and non-orbiting scroll 106 to provide for axial displacement of non-orbiting scroll 106 while maintaining a sealed engagement with partition 32 to isolate discharge and suction pressure regions of compressor 10 from one another. More specifically, pressure within first annular recess 144 may urge seal assembly 20 into engagement with partition 32 during normal compressor operation.

Modulation assembly 27 may include a piston assembly 156, a valve assembly 158, and a biasing member 160. The piston assembly 156 may include an annular piston 162 and first and second annular seals 164, 166. Annular piston 162 may be located in second annular recess 145 and first and second annular seals 164, 166 may be engaged with inner and outer side walls 140, 142 to separate second annular recess 145 into first and second portions 168, 170 that are isolated from one another. First portion 168 may be in communication with first radial passage 152 and second portion 170 may be in communication with second radial passage 154. Valve assembly 158 may include a valve member 172 in communication with a pressure source 174 and with first radial passage 152, and therefore first portion 168. Biasing member 160 may include a spring and may be located in second portion 170 and engaged with annular piston 162.

Annular piston 162 may be displaceable between first and second positions. In the first position (FIG. 3), annular piston 162 may seal first, second, and third porting 148, 150, 151 from communication with second portion 170 of second annular recess 145. In the second position (FIG. 4), annular piston 162 may be displaced from first, second, and third porting 148, 150, 151, providing communication between first, second, and third porting 148, 150, 151 and second portion 170 of second annular recess 145. Therefore, when annular piston 162 is in the second position, first, second, and third porting 148, 150, 151 may be in communication with a suction pressure region of compressor 10 via second radial passage 154 providing a reduced capacity operating mode for compressor 10. Third porting 151 may generally prevent compression in pockets located radially outward from and isolated from first and second porting 148, 150 when annular piston 162 is in the second position.

Pressure source 174 may include a pressure that is greater than an operating pressure of the pockets in communication with first and second porting 148, 150. Valve member 172 may provide communication between pressure source 174 and first portion 168 of second annular recess 145 to displace annular piston 162 to the first position. Valve member 172 may prevent communication between pressure source 174 and first portion 168 of second annular recess 145 to displace annular piston 162 to the second position. Valve member 172 may additionally vent first portion 168 to the suction pressure region of compressor 10 to displace annular piston 162 to the second position. Biasing member 160 may generally bias annular piston 162 toward the second position.

What is claimed is:

1. A compressor comprising:

a housing;

a non-orbiting scroll member supported within said housing and including a first end plate and a first spiral wrap extending from said first end plate;

a first porting extending through said first end plate and having a first angular extent of at least twenty degrees;

an orbiting scroll member driven by a drive shaft, supported within said housing and including a second end plate having a second spiral wrap extending therefrom and meshingly engaged with said first spiral wrap to form a series of compression pockets, said first porting being in communication with a first of said compression pockets during a portion of a compression cycle of said orbiting and non-orbiting scroll members, said first and second spiral wraps abutting one another at a first location to define first modulated capacity pockets when said orbiting scroll member is in a first position, said first modulated capacity pockets including a set of radially outermost compression pockets located radially inward relative to said first porting and isolated from communication with said first porting during an entirety of said compression cycle, said first porting aligned with said second spiral wrap at a location radially outward from and directly adjacent said first modulated capacity pockets when said orbiting scroll member is in the first position, a starting point of said first porting being rotationally aligned with the first location and an ending point of said first porting being rotationally spaced from the starting point by said first angular extent in a rotational direction of said drive shaft; and a second porting extending through said first end plate and having a second angular extent of at least twenty degrees, said second porting being in communication with a second of said compression pockets during a portion of said compression cycle, said first and second spiral wraps abutting one another at a second location to define second modulated capacity pockets when said orbiting scroll member is in a second position subsequent to the first position, said second modulated capacity pockets including a set of radially outermost compression pockets located radially inward relative to said first and second porting and isolated from communication with said first and second porting during an entirety of said compression cycle, a starting point of said second porting being rotationally aligned with the second location and an ending point of said second porting being rotationally spaced from the starting point of said second porting in a rotational direction opposite the rotational direction of said drive shaft, the ending point of said second porting being rotationally spaced from said starting point of said first porting by less than 180 degrees in the rotational direction of said drive shaft.

2. The compressor of claim 1, wherein said second porting is aligned with said second spiral wrap at a location radially outward from and directly adjacent said second set of radially outermost pockets when said orbiting scroll member is in the second position.

3. The compressor of claim 1, wherein said second porting is in communication with said first modulated capacity pockets when said orbiting scroll member is in the first position.

4. The compressor of claim 1, wherein said second modulated capacity pockets correspond to said first modulated capacity pockets after displacement of said orbiting scroll member from the first position to the second position.

5. The compressor of claim 1, further comprising a third porting extending through said first end plate and in communication with one of said compression pockets located radially outward from said first modulated capacity pockets when said orbiting scroll member is in the first position.

6. The compressor of claim 5, wherein said third porting is located radially outward from a radially outer surface of said first spiral wrap less than 360 degrees inward along said first spiral wrap from an outer end thereof.

7. The compressor of claim 6, wherein said first porting is located radially inward relative to said third porting.

8. The compressor of claim 1, wherein a pressure in said first porting is continuously increasing during said compression cycle.

9. The compressor of claim 1, wherein said second spiral wrap overlies an entirety of said first porting when said orbiting scroll member is in the first position.

10. The compressor of claim 9, wherein said second spiral wrap overlies an entirety of said second porting when said orbiting scroll member is in the second position.

11. The compressor of claim 1, wherein said first porting is isolated from communication with said compression pockets by said second spiral wrap when said orbiting scroll member is in the first position.

12. The compressor of claim 1, wherein said first porting includes a continuous aperture along said angular extent.

13. The compressor of claim 1, wherein said first porting includes a series of discrete apertures along said angular extent.

14. The compressor of claim 1, further comprising a valve member in communication with said first porting to selectively provide communication between said one of said compression pockets and a bypass location external to said one of said compression pockets.

15. The compressor of claim 14, wherein said bypass location includes a suction pressure region of the compressor.

16. The compressor of claim 1, wherein said first porting is in communication with a suction pressure region of the compressor.

17. The compressor of claim 1, wherein the width of said first porting is less than the width of said second spiral wrap.

18. The compressor of claim 1, wherein a spiral extent of said first spiral wrap is greater than a spiral extent of said second spiral wrap, forming an asymmetric scroll arrangement.

19. A compressor comprising:

a housing;

a non-orbiting scroll member supported within said housing and including a first end plate and a first spiral wrap extending from said first end plate;

a first porting extending through said first end plate and having a first angular extent of at least twenty degrees;

an orbiting scroll member driven by a drive shaft, supported within said housing and including a second end plate having a second spiral wrap extending therefrom and meshingly engaged with said first spiral wrap to form a series of compression pockets, said first spiral wrap having a greater spiral extent than said second spiral wrap and forming an asymmetric scroll arrangement, said first porting being in communication with a first of said compression pockets during a portion of a compression cycle of said orbiting and non-orbiting scroll members, said first and second spiral wraps abutting one another at a first location to define first modulated capacity pockets when said orbiting scroll member is in a first position, said first modulated capacity pockets including a set of radially outermost compression pockets located radially inward relative to said first porting and isolated from communication with said first porting during an entirety of said compression cycle, said first porting aligned with said second spiral wrap at a location radially outward from and directly adjacent said first modulated capacity pockets when said orbiting scroll member is in the first position; and a second porting extending through said first end plate and having a second angular extent of at least twenty degrees, said second porting being in communication with one of said first modulated capacity pockets when said orbiting scroll member is in the first position and being in communication with a second of said compression pockets during a portion of said compression cycle, said first and second spiral wraps abutting one another at a second location to define second modulated capacity pockets when said orbiting scroll member is in a second position subsequent to the first position, said second modulated capacity pockets including a set of radially outermost compression pockets located radially inward relative to said first and second porting and isolated from communication with said first and second porting during an entirety of said compression cycle.

20. The compressor of claim 19, wherein a starting point of said first porting is rotationally aligned with the first location and an ending point of said first porting is rotationally spaced from the starting point by said first angular extent in a rotational direction of said drive shaft, a starting point of said second porting being rotationally aligned with the second location and an ending point of said second porting being rotationally spaced from the starting point of said second porting in a rotational direction opposite the rotational direction of said drive shaft, the ending point of said second porting being rotationally spaced from said starting point of said first porting by less than 180 degrees in the rotational direction of said drive shaft.

* * * * *

UNITED STATES PATENT AND TRADEMARK OFFICE

CERTIFICATE OF CORRECTION

PATENT NO. : 7,976,296 B2
APPLICATION NO. : 12/629432
DATED : July 12, 2011
INVENTOR(S) : Robert C. Stover et al.

It is certified that error appears in the above-identified patent and that said Letters Patent is hereby corrected as shown below:

Column 3, Line 1 "draft shaft" should be --drive shaft--.

Signed and Sealed this
Fourth Day of October, 2011

David J. Kappos

David J. Kappos
*Director of the United States Patent and Trademark Office*